United States Patent [19]

Sato

[11] 4,201,134

[45] May 6, 1980

[54] PRINTING PRESSURE DAMPING MECHANISM FOR HAND LABELER

[75] Inventor: Yo Sato, Tokyo, Japan

[73] Assignee: Kabushiki Kaisha Sato, Tokyo, Japan

[21] Appl. No.: 897,489

[22] Filed: Apr. 18, 1978

[30] Foreign Application Priority Data

Apr. 22, 1977 [JP] Japan ..... 52-045832

[51] Int. Cl.[2] ..... B41F 1/54

[52] U.S. Cl. ..... 101/288; 101/291; 101/292; 101/316; 101/93.02; 101/93.03; 400/166; 400/167; 400/389; 400/435; 400/437; 400/440.2; 400/652; 400/687

[58] Field of Search ..... 156/384; 101/287, 288, 101/291, 292, 316, 297, 298, 10, 93.02, 20, 93.03; 400/157, 3, 166, 167, 388, 388.1, 389, 397, 424, 428, 435, 437, 440.2, 648, 649, 652, 686, 687; 267/158; 227/132; 74/97, 2; 173/118, 120, 139; 251/75–78, 80, 251, 262, 263

[56] References Cited

U.S. PATENT DOCUMENTS

| | | | |
|---|---|---|---|
| 597,593 | 1/1898 | Sheldon | 101/10 |
| 811,071 | 1/1906 | Liberman | 101/10 |
| 2,314,677 | 3/1943 | Young | 400/438 |
| 3,477,371 | 11/1969 | Ringholz | 101/298 |
| 4,056,183 | 11/1977 | Beery | 400/649 |

FOREIGN PATENT DOCUMENTS

| | | | |
|---|---|---|---|
| 191152 | 11/1907 | Fed. Rep. of Germany | 400/437 |
| 1381973 | 11/1964 | France | 267/158 |
| 162965 | 4/1958 | Sweden | 267/158 |

*Primary Examiner*—William Pieprz

*Attorney, Agent, or Firm*—Ostrolenk, Faber, Gerb & Soffen

[57] ABSTRACT

A printing pressure damping mechanism for a hand labeler: A printing platen is pivotally mounted on the frame of the hand labeler. The platen has a printing portion at one side of its center of pivotal motion. A hand lever pivotally connected to the frame of the labeler carries a printing head, which is turned toward the printing platen when the hand lever is squeezed against the biasing force of a return spring. Shock-absorbing means, comprising a leaf spring on the hand lever and an elastic abutment member on the other side of the printing platen from the printing portion engage to turn the printing portion of the printing platen toward the printing head. The hand lever is further squeezed and moves to overcome the biasing force of the leaf spring when the printing head abuts against the printing portion of the platen. The squeezing force, which might otherwise be applied as a printing force to the printing platen through the hand lever, is damped to a preset level. Second shock-absorbing means act on the platen in opposition to the biasing force applied to help prevent double printing.

26 Claims, 3 Drawing Figures

PRINTING PRESSURE DAMPING MECHANISM FOR HAND LABELER

BACKGROUND OF THE INVENTION

1. Field of the Invention

The present invention relates to a label printing and applying device, preferably of a portable type, referred to hereafter as a hand labeler, and more particularly to a printing pressure damping mechanism for use with the hand labeler, by which the squeezed force applied to the hand lever is damped to a preset level so as to maintain the printing pressure applied by the printing head at a constant level.

2. Description of the Prior Art

When the operating or hand lever of a hand labeler is squeezed, the yoke which is part of the hand lever is turned so that the printing head, which is carried by the yoke, is brought into abutment engagement with the platen which is fixed to the body of the hand labeler. This abutment prints the labels on the platen with desired indicia. Because the yoke of the hand labeler is turned by a manual operation, the printing pressure of each printing stroke by each operator would be different. In such a hand labeler, the platen is usually fixed to the body of the labeler. The type surface of the printing head is brought into abutment contact with the platen with a strong force. When the type surface to be printed is made of a rigid material, such as metal, the resultant strong printing force cannot be damped by the fixed platen and the printing head is vibrated with a small amplitude in the direction to and from the platen resulting in double printing on the labels.

On the other hand, if the type surface of the printing head is made of an elastic material, such as rubber, during the printing, the types are crushed on the platen, causing the imprints on the labels to be unclear.

Further, a rigid material type surface, may scratch or damage the label surfaces or the type surface and/or the surface of the platen may become worn or damaged due to the strong printing force.

Moreover, the rebound caused when the printing head hits the platen is transmitted to the hand of the user directly through the hand lever with the resultant disadvantages that the user has an uncomfortable feeling and that the squeezing operation cannot be carried out smoothly.

SUMMARY OF THE INVENTION

It is an object of the present invention to provide a printing pressure damping mechanism for use with a hand labeler, or the like, which can overcome the drawbacks of conventional printing devices.

It is another object of the invention to provide such a mechanism which damps printing pressure to a preset level, no matter how much force is applied to the operating or hand lever of the labeler.

A printing pressure damping mechanism according to the present invention is used on a hand labeler, which is operative to print a label and to apply the printed label to a commodity. The damping mechanism is comprised of the following elements. There is a printing platen which is mounted pivotally on the frame of the hand labeler. The platen has a printing portion at one side of its center of pivotal motion. An operating lever for operating the labeler, and, more specifically, a hand lever is mounted on the frame of the hand labeler for pivotal movement between a released position and a squeezed position. A return spring biases the hand lever toward the released position. A printing head is carried by the hand lever and is movable between an inoperative position, which is away from the printing portion of the printing platen when the hand lever is at the released position, and a printing position, which is against the printing portion of the printing platen, when the hand lever is at the squeezed position. Shock-absorbing or damping means are placed between the hand lever and the other side of the center of pivotal motion of the printing platen with respect to the printing portion of the platen. The shock-absorbing means cooperate with the moving hand lever to turn the printing portion of the printing platen toward the printing head, and after such pivoting of the platen, the hand lever is further squeezed against the biasing force of the shock-absorbing means. As a result, the squeezing force, which might otherwise be applied as a printing pressure to the printing platen through the hand lever, can be damped to a preset level by the rocking of the platen and by the springiness of the shock-absorbing means. The platen and the printing head may be forced into contact to ensure clear printing of the labels without damaging the type surface of the printing head and the surface of the platen. Further, the rebound of the impact of the printing head on the platen, which is transmitted to the hand lever upon each printing operation, is damped so as to eliminate user discomfort and so as to smooth the squeezing of the hand lever.

Second shock-absorbing means are mounted between the frame of the hand labeler and the printing platen for biasing the printing portion of the printing platen away from the printing head and in opposition to the biasing force applied by the operating lever, so that the printing head may be prevented from bouncing on the platen, thereby to prevent double printing.

BRIEF DESCRIPTION OF THE DRAWINGS

Other objects and features of the present invention will become apparent from the following description taken in conjunction with the accompanying drawings, in which.

DESCRIPTION OF A PREFERRED EMBODIMENT

Figure 1:
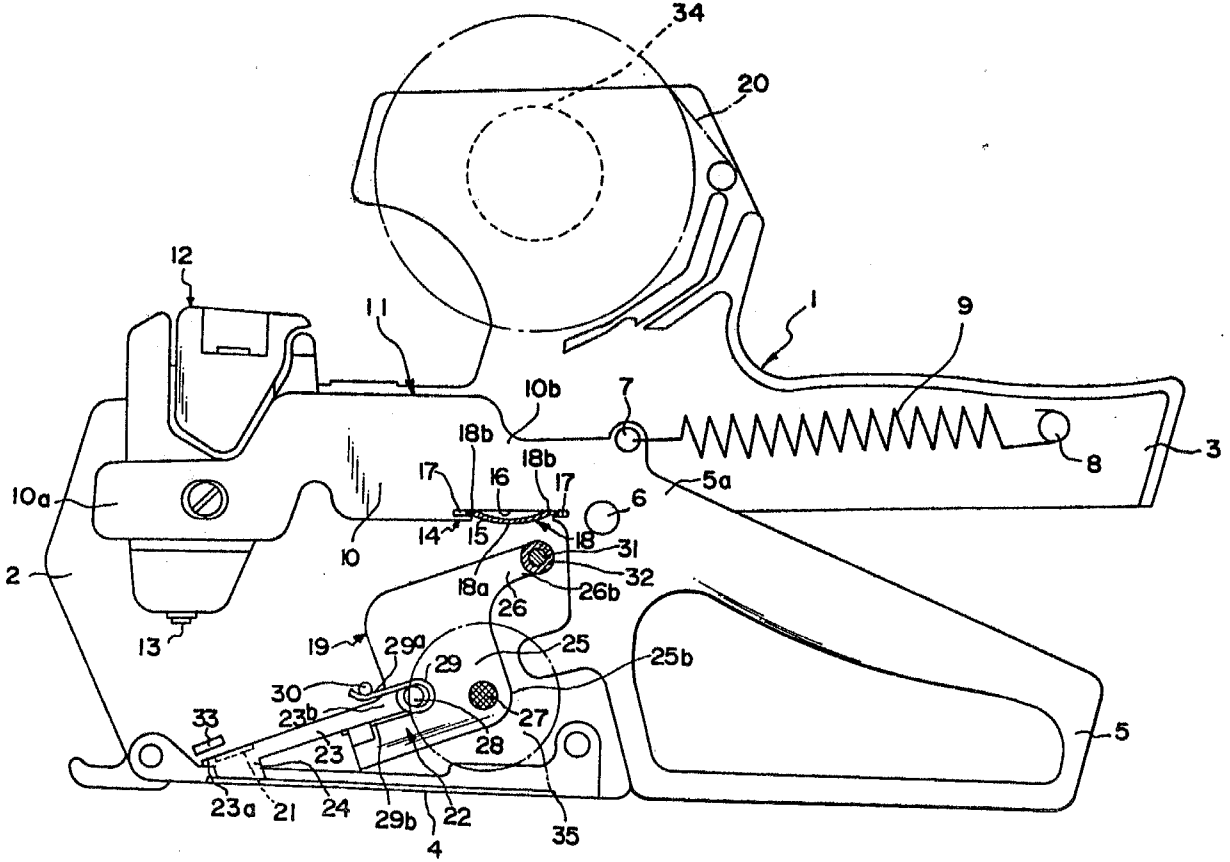
FIG. 1 is a partially cut-away, side elevational view showing a hand labeler, which is equipped with a printing pressure damping mechanism according to the present invention in the condition wherein the hand lever is released, with the side frame of the hand labeler on the viewing side being removed.

The printing apparatus or hand labeler has a body 1, which is comprised of a pair of parallel, spaced apart side frames 2. A hollow grip 3 is integrally formed with the side frames 2 and extends from the upper rear (or right-hand) ends of the side frames 2. A bottom plate 4 is removably attached to the lower end portions of the side frames 2. The remaining elements are supported by and between the side frames.

To the rear of the side frames 2 beneath the grip 3, there is a labeler operating lever 5, and more specifically a hand lever, which is pivotally attached to the grip 3 by a pivot pin 6. The return spring 9 is mounted under tension between a spring retaining hole 7 formed at the upper edge of the hand lever 5 and a spring retaining pin 8 mounted in the grip 3 such that the hand lever 5 is always biased clockwise, as viewed in FIG. 1. Thus, the hand lever 5 is normally held in a released position.

The front end portion 5*a* of the hand lever 5 projects to and defines a yoke 11, which has two parallel side walls 10. A printing head 12 is carried between the front end portions 10*a* of the yoke side walls 10. The type surface 13 of the printing head 12 projects downwardly.

Leaf spring holders 14 are provided at the rear end portions 10*b* of and on the undersides of both yoke side walls 10.

Each leaf spring holder 14 beneath a side wall 10 is an opening having a short height, generally T-shaped cross-section. The holder 14 includes a recessed portion 15, which opens on the lower surface of the corresponding side wall 10 and a pair of retaining grooves 17 which are formed integrally along the inner wall 16 of the recessed portion 15.

A leaf spring 18 having a preset spring force is removably fitted in the leaf spring holder 14. The leaf spring cooperates with the below described abutment 32 to define shock-absorbing means. The center portion 18*a* of spring 18 is normally warped to be curved downwardly toward the below described platen 19 from the recessed portion 15. Both end portions 18*b* of spring 18 are slidable into and out of the retaining grooves 17 in the longitudinal direction (i.e., to the right and left, as viewed in FIG. 1) of the yoke 11.

The platen 19 is located between the side frames 2 of the body 1 below the yoke 11. The platen is expressly described herein as pivoting between its position with respect to the frames 2. More broadly stated, however, the platen must be merely shiftable or rockable with respect to the frame, under the biasing and urging described below. The platen is comprised of a printing portion 21, on which labels from a below-described continuous strip of labels 20 are placed for being printed by the type surface 13 of the printing head 12.

The platen is further comprised of a pair of platen side plates 22 which are mounted to the both sides of the printing portion 21 of the platen. Each platen side plate 22 includes a generally rectangular holding portion 23, which holds up one side edge of the printing portion 21, and includes a stopper portion 24 which is formed at the lower front end 23*a* of the holding portion 23. Each side plate has a square portion 25 which is formed at the rear end 23*b* of the holding portion 23 in an integral manner. There is a generally rectangular abutment portion 26 which is formed at the rear edge 25*b* of each square portion 25 in a manner to project from the upper edge of the square portion 25.

The square portions 25 are pivotally supported at the lower ends of the rear edges 25*b* by a pivot pin 27, which is fixed in position to the side frames 2 of the body 1. The square portion 25 is also equipped with a spring retaining pin 28, which is positioned at the back of the rear end 23*b* of the holding portion 23 and on which the center portion of a torsion spring 29 is wound. The spring 29 and its mounting define second shock-absorbing means. One end 29*a* of the torsion spring 29 is held on a spring retaining pin 30, which is mounted to the corresponding side frame 2, while the other end 29*b* of the spring 29 is held on the rear end 23*b* of the holding portion 23.

The platen 19 is constantly biased counterclockwise, as viewed in FIG. 1, by the force of the torsion spring 29 such that the platen is held in an inclined position at which its stopper portion 24 abuts against the upper surface of the bottom plate 4 and at which the abutment portion 26 is located in the vicinity of the leaf spring 18.

Figure 3:
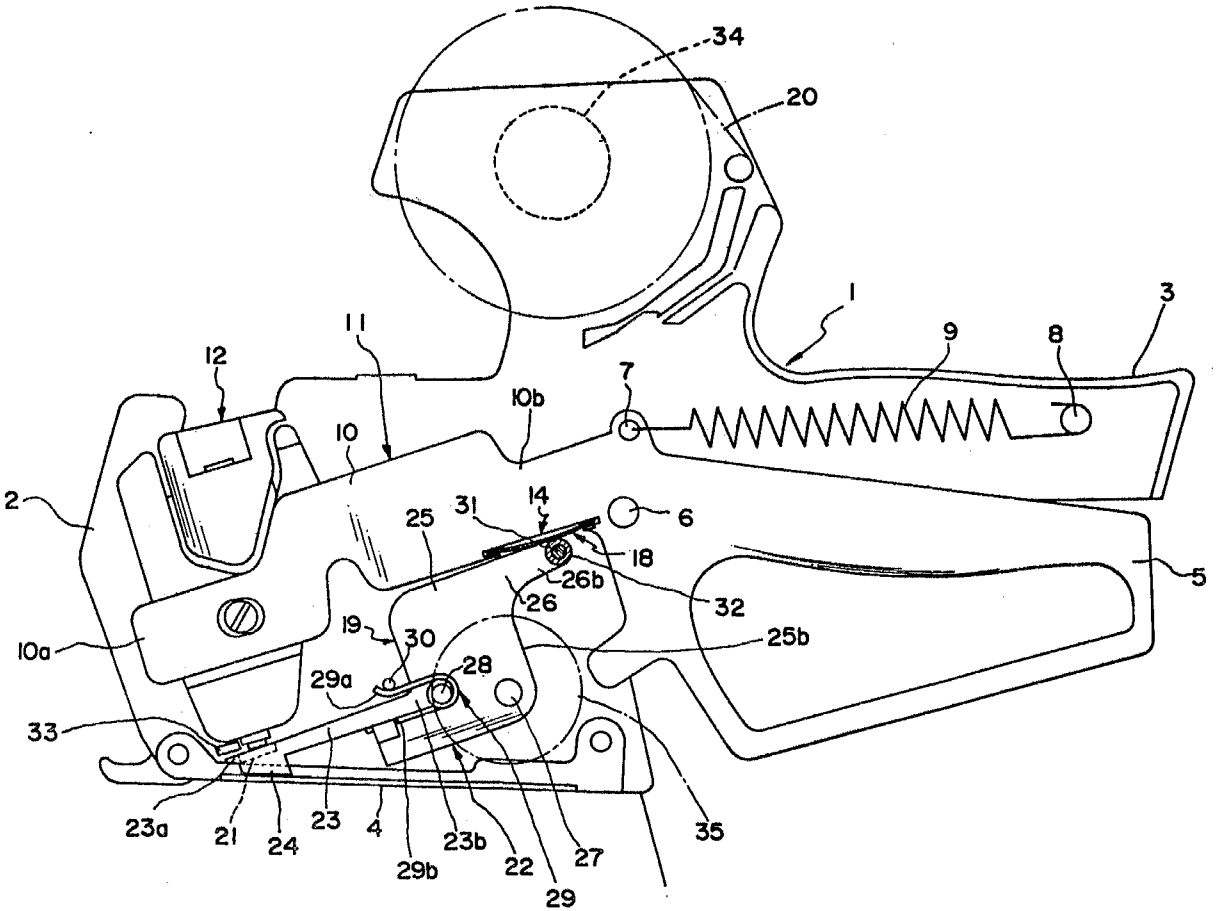
FIG. 3 is also the same view, showing the condition in which the hand lever is fully squeezed during the printing operation.

The spring force of the torsion spring 29, by which the platen 19 is biased counterclockwise about the pivot pin 27, is weaker than the spring force of the leaf spring 18 when it has been charged, which condition of spring 18 is established when its center portion 18*a* is deformed from the warped condition of FIG. 1 to the flattened condition of FIG. 3.

A pivot shaft 31 is interposed between the rear ends 26*b* of the abutment portions 26 of the platen side plates 22. An elastic member 32 comprised of rubber, or the like, and having a cylindrical shape is rotatably mounted on the shaft 31.

In the released condition of the labeler shown in FIG. 1, the elastic member 32 is positioned at a preset spacing from the lower surface of the warped center portion 18*a* of the leaf spring 18. As a result, there is no abutment contact between the leaf spring 18 and the member 32 until the yoke 10 is turned to a preset position.

Rocking motion regulating member 33 are mounted at preset positions to the side frames 2 of the body 1 for preventing the printing portion 21 of the platen 19 from rocking toward the printing head 12 beyond a predetermined position.

There is a continuous label strip 20 comprised of a strip of backing paper and a number of labels removably adhered in series to the backing paper strip. A label holder 34 is arranged at an upper center portion of the body 1 for rotatably holding the continuous label strip 20 rolled on it. The continuous label strip 20 is fed onto the platen from the label holder 34 by a feed roller 35. The feed roller is operated by a conventional feed arrangement connected to the hand lever. The feed roller 35 is turned a preset distance during each squeezing and releasing operation of the grip 3 and the hand lever 5.

The operation of the printing pressure damping mechanism is now described.

As shown in FIG. 1, the hand lever 5 is normally held in the released position by the biasing force of the return spring 9. The platen 19 is held with its stopper portions 24 abutting against the bottom plate 4 by the biasing force of the torsion spring 29 such that the printing portion 21 is spaced apart from the type surface 13 of the printing head 12 and the elastic member 32 is spaced apart from the leaf spring 18.

When the hand lever 5 is squeezed counterclockwise, as shown in FIG. 1, toward the grip 3 against the biasing force of the return spring 9, the yoke 11 and the printing head 12 are accordingly turned counterclockwise about the pivot pin 6.

Figure 2:
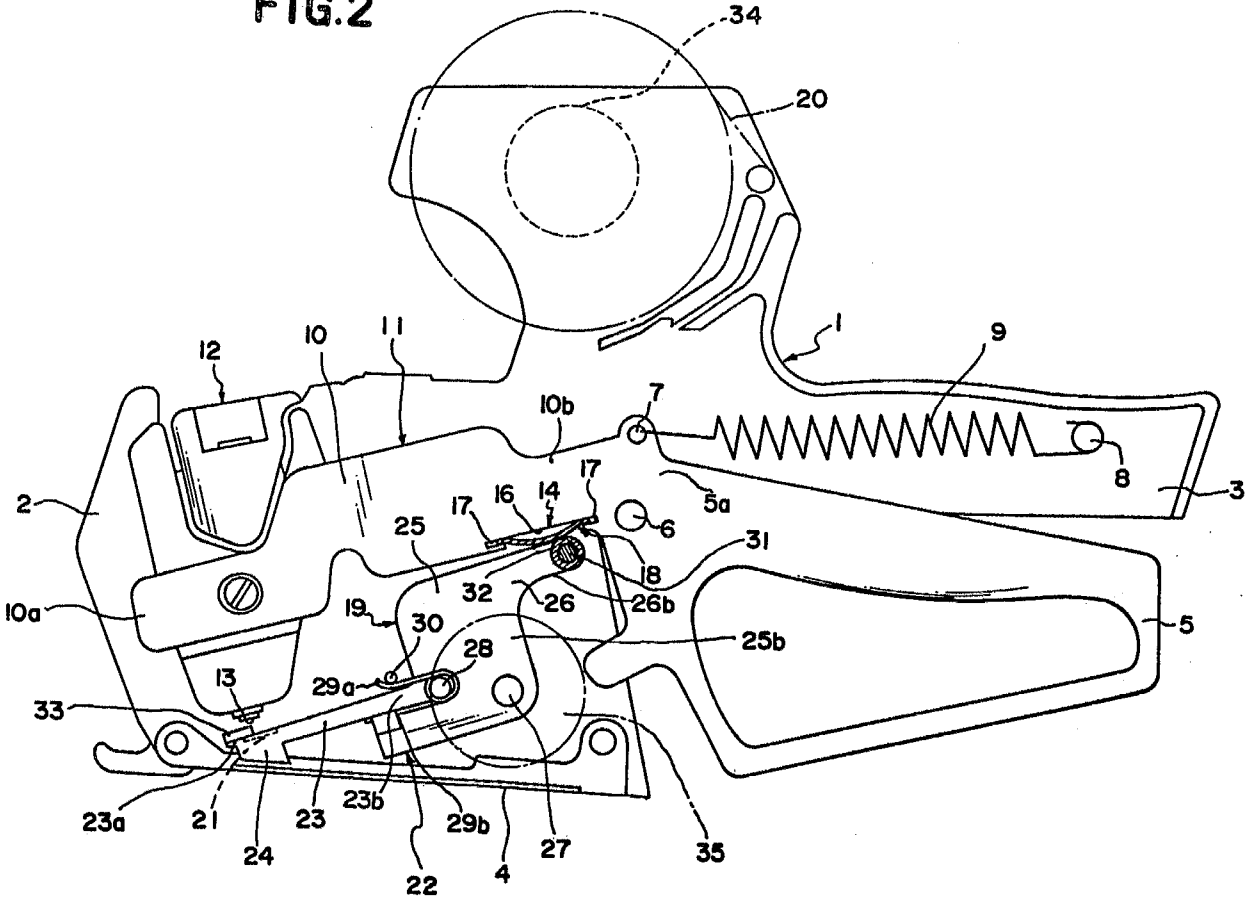
FIG. 2 is the same view as FIG. 1 showing the labeler in the condition in which the hand lever is squeezed and turned to bring the leaf spring into abutment contact with the platen.

After the yoke 11 has been turned through a preset angle, the leaf spring 18 moves into abutment contact with the elastic member 32 on the abutment member 26 of the platen 19 so that the abutment portion 26 is turned clockwise, as seen in FIG. 2, about the pivot pin 27. This turns the printing portion 21 of the platen 19 clockwise about the pivot pin 27 and against the biasing force of the torsion springs 29 until the printing portion 21 abuts against the rocking motion regulating members 33.

As the yoke 11 is further turned counter-clockwise slightly from the condition shown in FIG. 2, the type surface 13 of the printing head 12 is brought into abutment contact with the printing portion 21 of the platen 19 through its abutting against the continuous label strip 20. The platen is now returned counter-clockwise, as viewed in FIG. 2, about the pivot pin 27. At the same time the abutment portions 26 of the platen 19 are also turned counter-clockwise, as seen in FIG. 2, about the pivot pin 27. This motion of the elastic member 32 of the abutment portion 26 flattens the center portion 18*a* of the leaf spring 18 against its normal biasing force from the warped condition of FIGS. 1 and 2 to the flattened condition of FIG. 3, while the both longitudinal end portions 18*b* of the spring slide into the retaining grooves 17 of the leaf spring holders 14.

The biasing force of the leaf spring 18 acts to turn the abutment portions 26 of the platen 19 clockwise, as seen in FIG. 3, about the pivot pin 27. This forces the printing portion 21 of the platen 19 into contact with the type surface 13 of the printing head 12 with the preset biasing force of spring 18 so that the printing pressure can be kept always at a preset level.

When the hand level 5 is released from the squeezed position, the hand lever 5, the yoke 11 and the printing head 12 are turned clockwise, as viewed in FIG. 3, about the pivot pin 6 by the biasing force of the return spring 9. When the printing head 12 and the leaf spring 18 leave the printing portion 21 and the elastic member 32 of the platen 19, respectively, the platen 19 is returned counterclockwise about the pivot pin 27 by the biasing force of the torsion spring 29 until the stopper portions 24 of the platen abut against the bottom plate 4, thus restoring the condition shown in FIG. 1.

As has been described above, the printing pressure damping mechanism causes a preset printing pressure which is determined by the biasing force of the leaf spring 18.

As the thickness or hardness of the continuous label strip 20 is varied, the printing pressure can be accordingly preset at a suitable level merely by selecting leaf springs 18 of different biasing forces for insertion in the leaf spring holders 14. The leaf spring 18 can be replaced in a simple manner by fitting both end portions 18*b* into the retaining grooves 17 through the recessed portion 15.

Since both end portion 18*b* of the leaf spring are slidably fitted in the retaining grooves 17, the deformation of the center portion 18*a* of the spring from the warped condition of FIG. 1 to the flattened condition of FIG. 3 can be accomplished smoothly and easily so that the damping of the printing pressure can be accomplished smoothly.

Although the leaf spring 18 is shown on the yoke 11, according to the present invention, the leaf spring 18 may instead be provided at the side of the platen 19 carrying the abutment portions 26 so as to be abutted by the yoke 11. The leaf spring would be received in a spring holder in the platen, which is like the spring holder 14. The same above described operation would occur. As another alternative, a different elastic member, such as a coil spring, may be interposed between the yoke 11 and the platen 19. In short, the printing pressure of the printing head 12 is damped to a preset level according to the invention by interposing a suitable elastic member between the yoke 11 and the platen 19.

The printing pressure damping mechanism according to the invention includes a platen that is rockable or pivotable between its position and includes a printing portion at one side of the platen, with respect to the center of the rocking motion. The printing head is brought into abutment contact with the platen printing portion for the printing of labels thereon. At the other side of the center of rocking motion of the platen, the platen has abutment portions, with which the yoke is brought into abutment contact. An elastic member for damping the printing pressure of the printing head is interposed between those abutment portions and the yoke.

The following advantages are obtained with the invention:

(1) Even if the printing head is brought into abutment contact with the printing portion of the platen with excessive force, this force is damped by the pivoting of the platen against a shock-absorbing means, and is further damped to a preset level by the action of the elastic member so that clear imprints, without any shading, can be obtained on the labels.

(2) Because the elastic member not only damps the printing pressure but also forces the printing portion of the platen into contact with the printing head, the platen and the printing head can be kept in contact at all time during the printing operation, thus ensuring proper printing. (3) Even if the type surface of the printing head and/or the imprinting surface of the platen are made of a rigid material, such as metal, there need be no fear of wear or damage to the type surface and/or the platen by the printing pressure, which might otherwise be raised to an excessive level.

(4) Since the impact between the printing head and the platen during printing is damped, the user of the labeler has no discomfort and smooth turning operation of the yoke is assured.

(5) Since the overall construction of the labeler is kept simple, the assembly and production steps can be accordingly simplified, while reducing the production cost of the labeler to a reasonable level.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A printing pressure damping mechanism for a hand labeler, or the like, comprising:

a frame;

a platen pivotally mounted to said frame at a platen pivot on said frame; said platen having a printing portion at one side of said pivot and said printing portion being pivoted as said platen is pivoted; said platen having another side at the other side of said pivot from said printing portion;

an operating lever movable with respect to said frame between a released position and a squeezed position; at said released position, said operating lever being spaced apart from said platen other side; said operating lever being movable toward engagement with said platen other side;

a printing head carried by said operating lever and movable with said operating lever between an inoperative position wherein said printing head is apart from said printing portion of said platen when said operating lever is at said released position, and a printing position of said printing head wherein said printing head abuts said platen printing portion, when said operating lever is at said squeezed position;

shock-absorbing means interposed between said operating lever and said platen other side, such that motion of said operating lever toward said squeezed position causes engagement between said operating lever and said platen other side through said shock-absorbing means, and further motion of said operating lever to said squeezed position biases said platen other side to move said platen printing portion to pivot toward said printing head; said shock-absorbing means being adapted to absorb force applied by said operating lever against said shock-absorbing means, whereby the squeezing force of said operating lever against said platen is damped.

2. The printing pressure damping mechanism of claim 1, further comprising second shock-absorbing means mounted between said frame and said platen for biasing said printing portion of said platen away from said printing head, whereby said printing head may be prevented from bouncing on said platen.

3. The printing pressure damping mechanism of claim 1, wherein said shock-absorbing means comprises a spring.

4. The printing pressure damping mechanism of claim 3, wherein said shock-absorbing means comprises a normally warped leaf spring which is deformed and flattened when pressure is applied thereto.

5. The printing pressure damping mechanism of claim 4, further comprising a slidable mounting for said leaf spring in one of said operating lever and said platen other side, and said mounting being placed such that said leaf spring faces toward the other of said operating lever and said platen other side which does not include said mounting; said leaf spring being slidable in its said mounting when said leaf spring is flattened through force being applied to said leaf spring by the engagement of said operating lever and said platen other side.

6. The printing pressure damping mechanism of claim 4, further comprising a slidable mounting for said leaf spring in said operating lever; said mounting being placed such that said leaf spring faces toward said platen other side; said leaf spring being slidable in its said mounting when said leaf spring is flattened through force being applied to said leaf spring by the engagement of said of said leaf spring and said platen other side.

7. The printing pressure damping mechanism of any of claims 1, 5 or 6, wherein said operating lever is pivotally mounted to said frame for pivotally moving between said released and said squeezed positions thereof.

8. The printing pressure damping mechanism of claim 7, further comprising a return spring for biasing said operating lever normally toward said released position thereof.

9. The printing pressure damping mechanism of either of claims 1 or 6, further comprising a stopper mounted to said frame for restricting the extent of the pivoting of said platen toward said printing head under the influence of said operating lever engaging said shock absorbing means.

10. The printing pressure damping mechanism of claim 6, further comprising an abutment on said platen other side placed thereon so as to be abutted by said spring.

11. The printing pressure damping mechanism of claim 10, wherein said abutment includes an elastic member thereon.

12. The printing pressure damping mechanism of either of claims 10 or 11, wherein said abutment is rotatably mounted to said platen and said abutment has a cylindrical shape for providing rotatable engagement with said leaf spring.

13. The printing pressure damping mechanism of either of claims 3 or 4, wherein said spring is on one of said operating lever and said platen other side; said shock-absorbing means further comprising an abutment on the other of said operating lever and said platen other side and said abutment being so placed as to be abutted by said spring.

14. The printing pressure damping mechanism of claim 13, wherein said operating lever is pivotally mounted to said frame for pivotally moving between said released and said squeezed positions thereof.

15. The printing pressure damping mechanism of claim 14, further comprising a return spring for biasing said operating lever normally toward said released position thereof.

16. The printing pressure damping mechanism of claim 13, wherein said abutment includes an elastic member thereon.

17. The printing pressure damping mechanism of claim 13, wherein said abutment is rotatably mounted to said platen and said abutment has a cylindrical shape for providing rotatable engagement with said leaf spring.

18. The printing pressure damping mechanism of claim 17, wherein said abutment includes an elastic member thereon.

19. The printing pressure damping mechanism of claim 13, further comprising second shock-absorbing means mounted between said frame and said platen for biasing said printing portion of said platen away from said printing head, whereby said printing head may be prevented from bouncing on said platen.

20. The printing pressure damping mechanism of either of claims 2 or 19, wherein said second shock-absorbing means comprises a torsion spring having one end mounted to said frame and having another end mounted to said platen.

21. A printing pressure damping mechanism for a hand labeler, or the like, comprising:

a frame;

a platen rockably supported by said frame for rocking between different positions of said platen with respect to said frame; said platen having a printing portion at one part thereof and which is moved as said platen is rocked; said platen having another portion thereof away from said platen one portion;

an operating lever movable with respect to said frame between a released position and a squeezed position; at said released position, said operating lever being spaced apart from said platen other portion; said operating lever being movable toward said platen other portion;

a printing head carried by said operating lever and movable therewith between an inoperative position apart from said printing portion of said platen when said operating lever is at said released position, and a printing position wherein said printing head abuts said platen printing portion, when said operating lever is at said squeezed position;

shock-absorbing means interposed between said operating lever and said platen other portion, such that motion of said operating lever toward said squeezed position causes engagement between said operating lever and said platen other portion through said shock-absorbing means, and further motion of said operating lever to said squeezed position biases said platen other portion to rock said platen printing portion toward said printing head, and said shock-absorbing means being adapted to absorb force applied by said operating lever against said shock-absorbing means, whereby squeezing force of said operating lever against said platen is damped.

22. The printing pressure damping mechanism of claim 21, further comprising second shock-absorbing means mounted between said frame and said platen for biasing said printing portion of said platen away from said printing head, whereby said printing head may be prevented from bouncing on said platen.

23. A printing pressure damping mechanism for a hand labeler, or the like, comprising:

a frame;

a platen pivotally mounted to said frame at a platen pivot on said frame; said platen having a printing portion at one side of said pivot and said printing portion being pivoted as said platen is pivoted; said platen having another side at the other side of said pivot from said printing portion;

an operating lever movable with respect to said frame between a released position and a squeezed position;

a printing head carried by said operating lever and movable with said operating lever between an inoperative position wherein said printing head is apart from said printing portion of said platen when said operating lever is at said released position, and a printing position of said printing head wherein said printing head abuts said platen printing portion, when said operating lever is at said squeezed position;

shock-absorbing means interposed between said operating lever and said platen other side, such that engagement between said operating lever and said platen other side, through said shock-absorbing means, biases said platen other side to move said platen printing portion to pivot toward said printing head; said shock-absorbing means being adapted to absorb force applied by said operating lever against said shock-absorbing means, whereby the squeezing force of said operating lever against said platen is damped;

second shock-absorbing means mounted between said frame and said platen for biasing said printing portion of said platen away from said printing head, whereby said printing head may be prevented from bouncing on said platen.

24. The printing pressure damping mechanism of claim 23, wherein said second shock-absorbing means comprises a torsion spring having one end mounted to said frame and having another end mounted to said platen.

25. The printing pressure damping mechanism of claim 23, further comprising a return spring for biasing said operating lever normally toward said released position thereof.

26. The printing pressure damping mechanism of claim 25, wherein said operating lever is pivotally mounted to said frame for pivotally moving between said released and said squeezed positions thereof.

* * * * *